United States Patent [19]

Meindl

[11] Patent Number: 4,466,681

[45] Date of Patent: Aug. 21, 1984

[54] SOLDERING LUG FOR MOUNTING ELECTRICAL CONDUCTING WIRES

[75] Inventor: Gerhard Meindl, Alling, Fed. Rep. of Germany

[73] Assignee: Siemens Aktiengesellschaft, Berlin & Munich, Fed. Rep. of Germany

[21] Appl. No.: 419,416

[22] Filed: Sep. 20, 1982

Related U.S. Application Data

[63] Continuation of Ser. No. 209,317, Nov. 24, 1980, abandoned.

[30] Foreign Application Priority Data

Dec. 14, 1979 [DE] Fed. Rep. of Germany ..... 2950415

[51] Int. Cl.[3] ..... H01R 9/06

[52] U.S. Cl. ..... 339/97 R; 339/275 A

[58] Field of Search ..... 339/95, 97–99, 339/275 A, 276 C, 277 C, 278 A, 97 R

[56] References Cited

U.S. PATENT DOCUMENTS

| | | | |
|---|---|---|---|
| 2,734,177 | 2/1956 | Gilbert | 339/97 R |
| 3,027,536 | 3/1962 | Pasternak | 339/97 R |
| 3,054,027 | 9/1962 | Barrick et al. | 339/275 A |
| 3,181,107 | 4/1965 | Garber et al. | 339/97 R |
| 3,368,114 | 2/1968 | Campbell et al. | 361/421 |
| 3,845,455 | 10/1974 | Shoemaker | 339/97 R |
| 4,036,546 | 7/1977 | Thompson et al. | 339/95 R |

*Primary Examiner*—Joseph H. McGlynn

*Attorney, Agent, or Firm*—Hill, Van Santen, Steadman & Simpson

[57] ABSTRACT

A soldering lug is support-mounted in slot-like openings of a coil form flange of a coil form having an electric coil wound thereon. The soldering lug preferably has legs directed at right angles relative to one another, one of the legs serving as a contact pin for the conducting wires, and the other as a contact pin for electric printed circuit boards. The soldering lugs, at least at their free ends serving to mount the conducting wires, have laminated leaf spring members which are spread apart in a V-shaped formation.

8 Claims, 8 Drawing Figures

SOLDERING LUG FOR MOUNTING ELECTRICAL CONDUCTING WIRES

This is a continuation of application Ser. No. 209,317, filed Nov. 24, 1980, now abandoned.

BACKGROUND OF THE INVENTION

The invention relates to a soldering lug for mounting electrical conductor wires and winding wires and, in particular, a soldering lug which is support-mounted in the coil form flange of an electrical coil.

Previously known pin-shaped or hook-shaped soldering lugs inserted into the flange of coil forms of electric coils must in most instances be wound or wrapped around with the coil wire in order to fix the winding wire ends. Soldering lugs are also known in which the winding wire ends are clamped or squeezed in through mechanical deformation of the soldering lug and are thereby fixed in position. All these know embodiments necessitate considerable time for fixing the winding wire ends, whereby, in part, additional auxiliary apparatus which is manually actuated, is necessary. Such an apparatus can be automated only with difficulty.

The known lamellar or plate-like soldering lug 1, illustrated in a partially fragmented fashion and in plan view in FIG. 1, has a notch-like edge recess 2 into which the winding wire end can be clamped. The disadvantage of this soldering lug is its rigid design which must be matched to the respective wire diameter. Varying wire thickness, accordingly require a different soldering lug design, respectively. Moreover, the danger always exits that the wires during fixation will be cut through by a sharp-edged notch.

SUMMARY OF THE INVENTION

It is an object of the invention to produce a soldering lug which, in a simple, destruction-free, and rapid manner, offers the possibility of securely fixing in their position electric conducting wires, particularly winding wires of varying thickness, until termination of the soldering operation. In particular, the soldering lug should be suitable for insertion in electrical coils whose winding proceeds automatically.

In the case of a soldering lug of the type initially cited, the invention provides, in order to achieve this objective, that the above-described soldering lug, at least at its free end which serves for mounting the electric conducting wires or winding wire ends, is formed from laminated leaf or plate springs which are spread in a V-formation, or is of a lamellar material with springy properties.

By means of this soldering lug, the wire, even in the case of varying wire thickness, can be rapidly and securely fixed in position. Through the drawing-in of the wire between the spread apart leaf spring ends alone, a support-mounting of the wire which is sufficient for the subsequent soldering operation is already guaranteed. An additional winding or wrapping around of the soldering lug with the wire, which has been customary up to the present time and is very costly, can be dispensed with. Through the drawing-in of the conventional electrically insulated winding wire ends into the soldering lug, the lacquer insulation at the location to be soldered is stripped or broken-up and a reliable and rapid soldering is thereby rendered possible.

This type of support-mounting guarantees a considerably higher economy as compared with the hitherto employed fixation and soldering procedures. In particular, in the case of automatic winding of coil forms, this soldering lug provides considerable advantages since the automatic winding machines can immediately draw the winding wire ends into the soldering lug and fix them in position.

DESCRIPTION OF THE PREFERRED EMBODIMENTS

The soldering lug can consist of two laminated leaf springs, whereby the ends of the leaf springs which are adjacent one another are spread apart in a V-shaped fashion. The mechanical connection of the leaf springs, for example by means of spot welding at their ends, is conceivable, as well as a soldering lug which consists of a single leaf spring which is folded 180° about its axis perpendicular to the leaf spring center.

The soldering lug is here mounted at its other end opposite the V-formation end in the coil form flange; e.g. it is cast into the latter or clamped or squeezed in corresponding slots.

It is also conceivable for the end of the soldering lug opposite the V-formation end to be designed in the form of an electric connection pin, e.g. for printed circuits, and for the soldering lug to be supported with its center section in a displaceable or shifting proof fashion in a slot-like perforation of the coil form flange.

Figure 1:
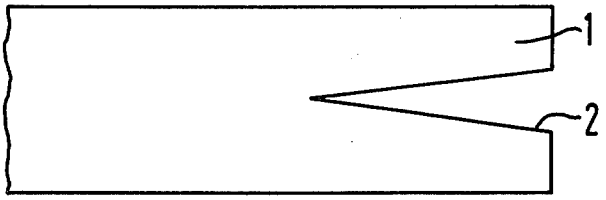
FIG 1 PRIOR ART
FIG. 1 is an illustration of a prior art soldering lug.
Figure 2:
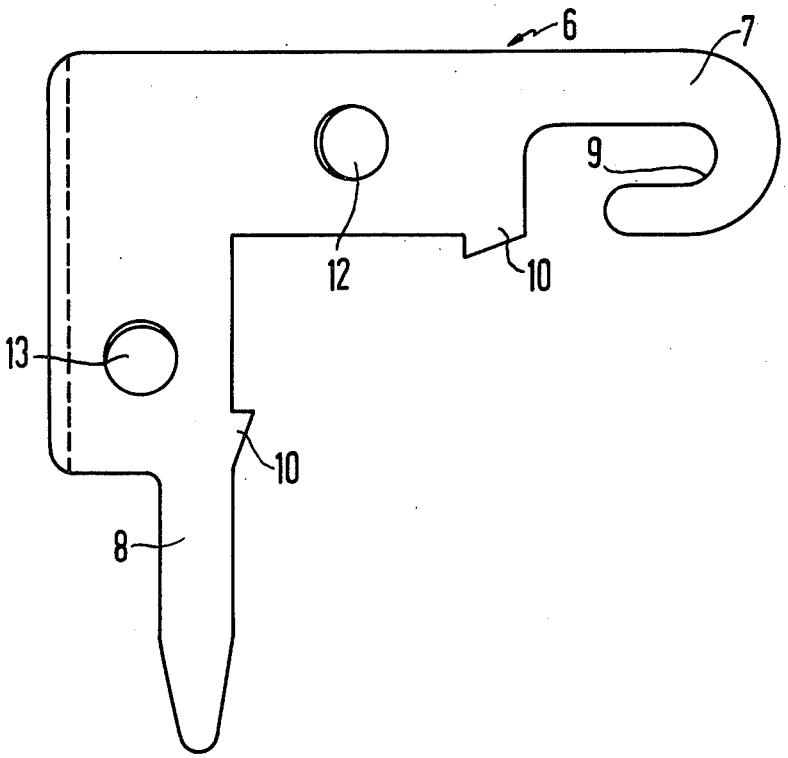
FIGS. 2 and 3 illustrate in lateral view and plan view, respectively, an embodiment of the lug in accordance with the invention.
Figure 3:
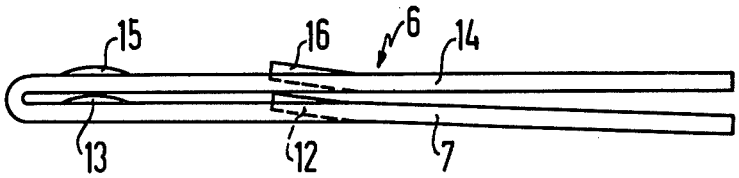

The soldering lug 6 according to FIGS. 2 and 3 consists of a laminated leaf spring pair whereby the leaf springs, in the region of the mutually parallel one leg pair 7, 14, are spread apart in a V-formation, and, in the region of the other leg pair 8, are designed in the form of a connection plug. According to FIG. 3, the leaf spring pair can be fabricated as a single piece from a T-shaped element consisting of spring plate or sheet metal folded 180° about its longitudinal center axis.

Figure 4:
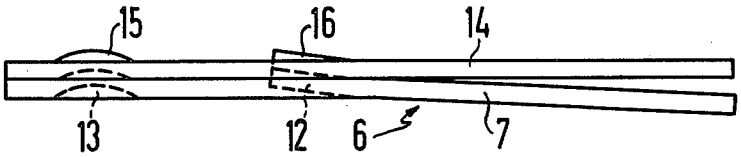
FIG. 4 illustrates a plan view of a second embodiment of the lug in accordance with the invention.

A soldering lug is also conceivable which, as already stated above, consists of two laminated leaf springs which are interconnected along the length of their one legs 8, for example, by means of spot welding, as is shown in FIG. 4. The same parts are here again provided with the same reference numerals.

Figure 5:
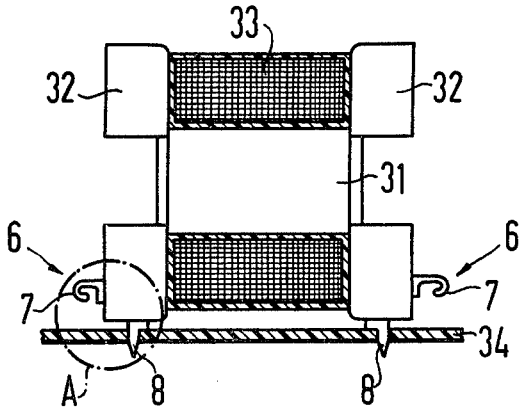
FIG. 5 illustrates an electric coil having soldering lugs in accordance with the invention which is suitable for the use of soldering lugs according to FIGS. 2 through 4.
Figure 6:
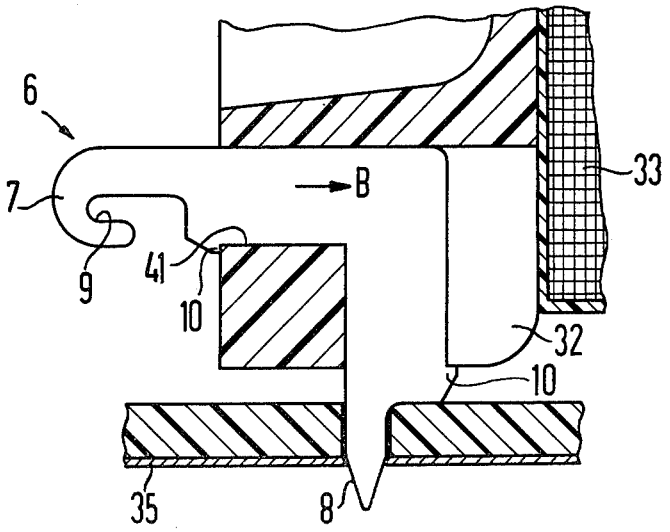
FIG. 6 illustrates a section "A" indicated in FIG. 5 in an enlarged scale.

The soldering lugs according to FIGS. 2 through 4 are particularly suited for use in coil form flanges such as are illustrated in FIGS. 5 and 6.

FIG. 5 illustrates a coil, wound with a winding 33, which is mounted on a printed circuit board 34, said coil comprising a coil form 31 with its longitudinal center axis parallel to the printed circuit board, comprising coil form flanges 32. The coil form flanges 32 exhibit, as can be recognized from FIG. 6, slide-in or insertable right-angled perforations 41 in which the soldering lugs 6 are inserted. The soldering lugs 6, for the purpose of fixation in the right-angled openings or perforations 41, have detent lugs 10 which are formed or molded on in one piece. For the purposes of additional fixation of the soldering lugs in the openings or perforations, the latter can be equipped with embossments or raised portions 13, 15, or 12, 16, respectively. With its pin-shaped portion 8, the soldering lug is guided through an opening or perforation in the printed circuit board and is e.g. soldered together with a printed conductor 35. The leaf spring ends 7, 14 may be shaped in a hook formation—as is indicated at 9—and thus afford the possibility of an additional fixation.

Figure 7:
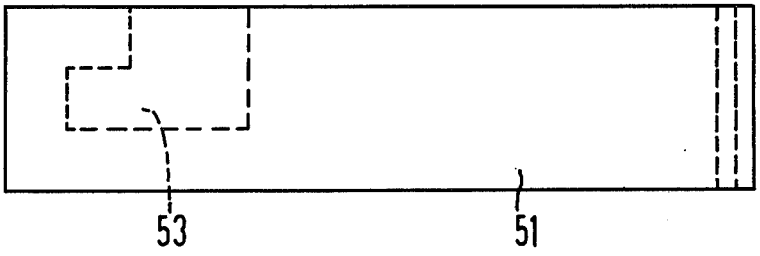
FIGS. 7 and 8 illustrate a third embodiment of a soldering lug in accordance with the invention in lateral view and plan view.
Figure 8:
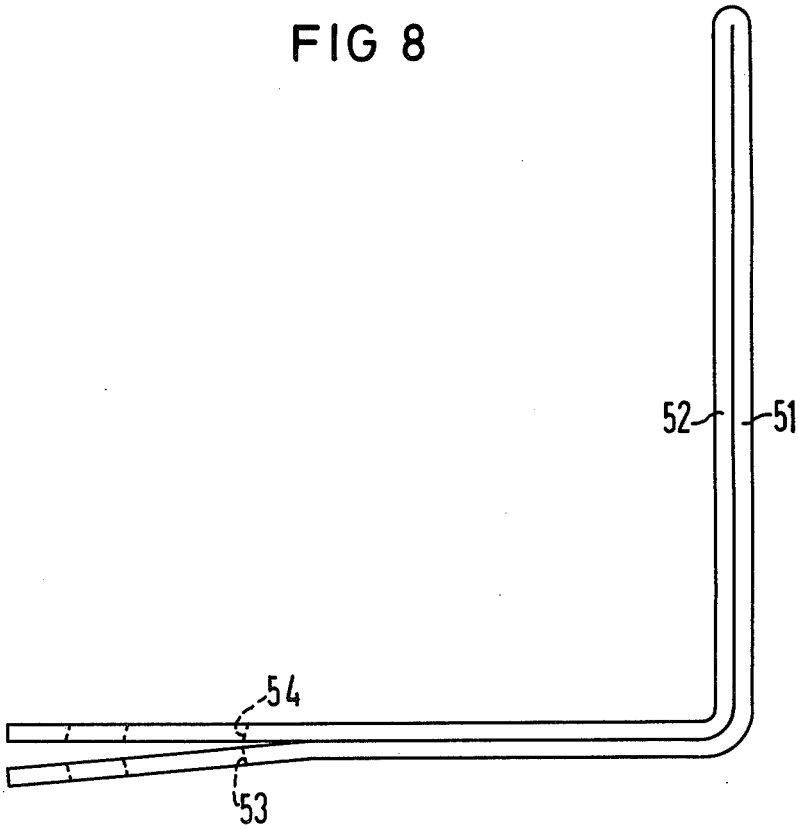

The sample embodiment according to FIGS. 7 and 8 illustrates a leaf spring which is folded 180° about its center, whose legs 51, 52 are additionally curved in an L-formation and equipped with hook-shaped recesses 53, 54 for the additional fixation of wires. This embodiment is suitable, for example, for use in pocket-like recesses in the coil form flange.

While we have disclosed an exemplary structure to illustrate the principles of the invention, it should be understood that we wish to embody within the scope of the patent warranted hereon all such modifications as reasonably and properly come within the scope of our contribution to the art.

I claim as my invention:

1. A coil form soldering lug for electrical connection to conducting wire ends of a coil wound on the coil form, said soldering lug being adapted for support-mounting in a flange of the coil form, the soldering lug comprising at its conducting wire attachment end lamellar leaf-spring members forming planar contact surfaces spaced directly across from each other, said planar contact surfaces being joined together at an apex and with a continually increasing spacing apart from one another away from the apex so as to define a V-formation, a spacing of the leaf-spring members ends away from the apex being sufficient to freely receive said coil conducting wire end therebetween, the leaf-spring members being shaped and spaced so as to scrape against the wire end with continually increasing pressure as it is drawn in towards the apex of the V-formation so as to provide a secure connection and to strip away portions of an insulating material which may be present at the wire end, an end of the soldering lug opposite the spread apart V-formation end being designed as an electrical connection pin, and the soldering lug having a supportmounting center section being adapted for shift-free mounting in a slot-like perforation of the coil form flange.

2. A soldering lug according to claim 1 characterized in that the ends of the two leaf-spring members at the apex comprise two separate pieces fastened together.

3. A soldering lug according to claim 1 wherein the soldering lug comprises a single leaf spring which is folded 180° about its axis perpendicular to the leaf-spring center so as to form the spread apart leaf-spring members.

4. A soldering lug according to claim 1 wherein the soldering lug comprises a lamellar leaf-spring pair having legs directed at substantially right angles relative to one another, the leaf springs in a region of the one leg being spread apart in said V-formation relative to one another, and in a region of the other leg, are designed as a connection pin for the coil form.

5. A soldering lug according to claim 1 wherein the soldering lug is formed of a T-shaped element comprising leaf-spring material folded 180° about its longitudinal center axis along a base of the T such that the spread apart leaf-spring members are formed by folded over top portions of the T.

6. A soldering lug according to claim 1 wherein the soldering lug is adapted for insertion in a right-angled perforation in the coil form flange in a shift-free fashion.

7. A coil assembly comprising: a coil form having a coil winding with connecting wire ends; two soldering lugs mounted in the coil form each having one end comprised of leaf spring members forming planar contact surfaces spaced directly across from each other, said planar contact surfaces being joined together at an apex and with a continually increasing spacing apart from one another away from the apex so as to define a V-formation; the leaf-spring member V-formation being adapted to freely receive one of the coil connecting ends between the V-formation ends opposite the apex and to press and scrape against the wire end with continually increasing pressure as it is drawn in towards an apex of the V-formation so as to hold the wire in position until soldering and partially strip away unwanted insulating material, if present; and the other end of the soldering lug forming a mounting lug and electrical connection for the coil assembly.

8. A soldering lug for electrical connection to a conducting wire end of an electrical component, comprising: one end of the soldering lug comprising spread apart lamellar leaf spring members forming planar contact surfaces spaced directly across from each other, said planar contact surfaces being joined together at an apex and with a continually increasing spacing apart from one another away from the apex so as to define a V-formation; the leaf-spring member ends away from the apex being spaced to freely receive the conducting wire end therebetween; the V-formation spring members being spaced and aligned to press and scrape against the wire end with continually increasing pressure as it is drawn in towards an apex of the V-formation so as to secure the wire end and partially strip away unwanted insulating material, if present; a central portion of the soldering lug being structured for mounting in a slot-like perforation of the electrical component; and the other end of the soldering lug being designed for soldering connection to another electrical connection point.

* * * * *